US006048127A

United States Patent [19]

Kern et al.

[11] Patent Number: 6,048,127

[45] Date of Patent: Apr. 11, 2000

[54] FURNITURE GANGING DEVICE

[75] Inventors: Kenneth A. Kern; Lawrence Rapier, both of Jasper, Ind.

[73] Assignee: Ditto Sales, Inc., Jasper, Ind.

[21] Appl. No.: 09/172,791

[22] Filed: Oct. 15, 1998

[51] Int. Cl.[7] ..... A47C 15/00

[52] U.S. Cl. ..... 403/389; 403/340; 108/158

[58] Field of Search ..... 403/389, 340, 403/385, 383, 398; 108/158, 157.1; 411/508, 509; 24/575

[56] References Cited

U.S. PATENT DOCUMENTS

| | | | |
|---|---|---|---|
| 613,663 | 11/1898 | Case | 403/340 |
| 1,851,733 | 3/1932 | Shapiro | 24/575 |
| 3,669,491 | 6/1972 | Weslock . | |
| 3,756,115 | 9/1973 | Schuplin | 411/508 |
| 3,965,952 | 6/1976 | Rivman et al. . | |
| 3,979,802 | 9/1976 | Bongartz et al. . | |
| 4,066,373 | 1/1978 | Workman . | |
| 4,300,852 | 11/1981 | Clark | 403/385 |
| 4,479,661 | 10/1984 | Weigl | 403/389 X |
| 4,591,289 | 5/1986 | Vickers et al. . | |
| 4,817,897 | 4/1989 | Kreusel | 403/385 X |
| 4,978,168 | 12/1990 | Piretti . | |
| 5,542,159 | 8/1996 | Schultz et al. . | |
| 5,706,559 | 1/1998 | Oliver et al. | 411/508 X |

*Primary Examiner*—Lynne H. Browne
*Assistant Examiner*—John R. Cottingham
*Attorney, Agent, or Firm*—Baker & Daniels

[57] ABSTRACT

A furniture system is which disclosed comprises a first and second structures 2, 5 each having a horizontal member 3, 6 and a number of vertical members 4, 7 that support the first horizontal member 3, 6. A releasable connection device 10 is included for each of the structures 2, 5. Each releasable connection device 10 has an attachment portion 15 configured to engage to one of the support members 4, 7 of one of the structures 2, 5. The connection device 10 further comprises an elongated connection portion 24 that projects from the attachment portion 15. A female fastener 30 is defined on a surface 29 of the connection portion 20, and a male fastener 40 projects from the surface 29 adjacent the female fastener 30. The male and female fasteners 40, 30 are snap engageable with respective female and male fastener 30, 40 of the other of the releasable connection device 10 engaged to one of the support members of the other of the structures. The releasable connection device 10 further comprises a release portion extending from an end of the connection portion 20. The release portion has a release tab 50 contiguous with the surface 21 of the connection portion 20. The release tab 50 extends outwardly from each of the pair of engaged devices 10 to receive and transmit a disengagement force to the fasteners.

21 Claims, 5 Drawing Sheets

FURNITURE GANGING DEVICE

FIELD OF THE INVENTION

This invention relates to devices for ganging two or more articles of furniture, such as tables, desks and chairs. In particular, the invention relates to ganging devices connecting legs or elongated members of the furniture.

BACKGROUND OF THE INVENTION

As the cost of doing business has increased due to increases in costs for personnel, insurance, office space and the like, a trend for downsizing office equipment and space has developed. This trend, along with the expanding presence of small businesses, has created a pressure for economy in the workplace. Part of this economy is that a space may be required to fulfill more than one role. At the same time, an awareness of the effects of office aesthetics on morale and productivity has created a desire for pleasant and efficient workspaces. Also, in many cases, open office plans must be divided into individual offices or workstations. Many arrangements are available to divide an open office space, including partition panels, systems furniture, and modular furniture. To meet these needs, attractive yet portable training, conference and office furniture is marketed by Versteel, P.O. Box 850, Jasper, Ind. 47547 (800-876-2120).

Often, it is desired to temporarily arrange structures, such as tables, desks and chairs, in rows or other configurations for training and other meetings. Such arrangements facilitates a productive meeting, maximizes seating capacity in a room of limited size and enhances sightlines of attendees at an event. In addition to aesthetic reasons, the orderly arrangement of structures in rows facilitates ingress and egress when large numbers of people are gathered together.

Oftentimes movable chairs are used to create a row or multiple rows of chairs, to allow flexible seating arrangements, and many different uses of the same floor space. A disadvantage to using movable chairs is that chairs may be accidentally displaced, thus causing a row to become disorganized. In addition to disturbing the aesthetic appearance of a room, the ability to easily disorganize a row of movable chairs creates a safety problem if the room's occupants are required to quickly exit, such as in case of a fire. In fact, local fire codes frequently required adjacent chairs to be interconnected in certain situations.

Interconnecting chairs greatly increases the stability of a single chair and makes it difficult to move. Thus, interconnecting chairs via a ganging device is commonly done to increase safety and enhance the aesthetic appearance of a room when a row or multiple rows of two or more chairs are required.

In many cases, it is desirable to temporarily interconnect desks or tables, leaving the chairs free. In situations where such desk top structures are needed, it is beneficial to provide desk top access to power and communication ports for computers and other electronic devices. Wires and cables must be fed from wall outlets to the first structure and then between each additional structure. Providing supply and communication access to each desk top in a temporary furniture arrangement presents challenges. Improper wire management or shifting of the structures can lead to interruptions in service, workplace hazards and poor aesthetics. Raceway systems for wire management are available from Versteel, P.O. Box 850, Jasper, Ind. 47547-0850 (800-876-2120). Ganging can be a particularly important part of wire management to avoid shifting of the tables which can pinch or disengage wires or cables.

Several patents disclose ganging devices for releasably connecting articles of furniture such as chairs and tables. However, there has remained a need for ganging devices that are non-handed or universal. Such devices would lower manufacturing costs by requiring tooling for only one type of part. Universal ganging devices would also greatly increase convenience because ganging any particular arrangement of furniture would be possible without need for purchasing and adding an additional ganging device. The chair or table would always have the proper ganging device. Because the structures may be later disconnected and moved into another arrangement for another purpose, such devices must be conveniently engageable and disengageable.

One type of universal chair ganging device is disclosed in U.S. Pat. No. 5,542,159 to Schultz et al. The Schultz device includes an attachment portion that partially wraps around a horizontal support of the chair. The coupling portion includes a male T-shaped coupling member next to a female coupling element. Two identical coupling members can be mated together by movement in a direction perpendicular to the plane of the floor. In other words, one coupling member must be lifted above the other coupling member before they are mated. This can be inconvenient and difficult if a gap in a row of chairs is to be re-mated. Alternatively the Schultz members can be pre-connected and then snapped onto the horizontal support.

Accordingly, there has remained a need for universal ganging devices which are convenient, inexpensive and attractive.

SUMMARY OF THE INVENTION

The present invention provides a universal device for connecting two tables or other articles of furniture. Using the devices of the present invention, furniture components can be disconnected from each other and reconnected in a different arrangement with ease and without the need for lifting furniture or removing the ganging device from the furniture. The ganging devices of this invention are of a relatively inexpensive construction and may be fabricated from any of several plastic compositions by means of conventional forming processes. The devices can be instantly engaged or disengaged to an identical device using the engagement and disengagement features of this invention.

In one embodiment, a furniture system is provided which includes first and second structures each having a horizontal member and a number of support members supporting the horizontal member. The system also includes a releasable connection device for each of the first and second structures. Each of the releasable connection devices has an attachment portion configured to engage one of the support members of one of the structures. A connection portion projects from the attachment portion and has a first end integral with the attachment portion and an opposite second end. A female fastener is defined on a surface of the connection portion and a male fastener projects from the same surface adjacent the female fastener. The releasable connection devices are universal in that the male and female fasteners are snap engageable with the respective male and female fasteners of another releasable connection device engaged to one of the support members of the other structure. The devices are equally suited for use with vertical support members, such as a leg, or horizontal members, such as a crossbar.

In one aspect of the invention, a quick release means is provided. The quick release means includes a release portion extending from the second end of the connection portion.

The release portion preferably has a release tab that is contiguous with the surface of the connection portion. The release tab extends outwardly from each of a pair of engaged devices for receiving and transmitting a disengagement force to the fasteners.

In one embodiment of the invention, the attachment portion surrounds a perimeter of one portion of a support member and conforms tightly to the geometry of the portion. In preferred embodiments, the attachment portion is a universal leash surrounding the leg of the structure. In such embodiments, the connection portion extends perpendicularly from the support member when the attachment portion is engaged to the support member.

One object of the present invention is to provide a universal ganging device that is easily and instantly engaged and disengaged. Another object is to provide a furniture ganging device that is economical to make and aesthetically pleasing when in use.

These and other objects, advantages and features are accomplished according to the devices and methods of the present invention.

DESCRIPTION OF THE PREFERRED EMBODIMENT

Figure 1:
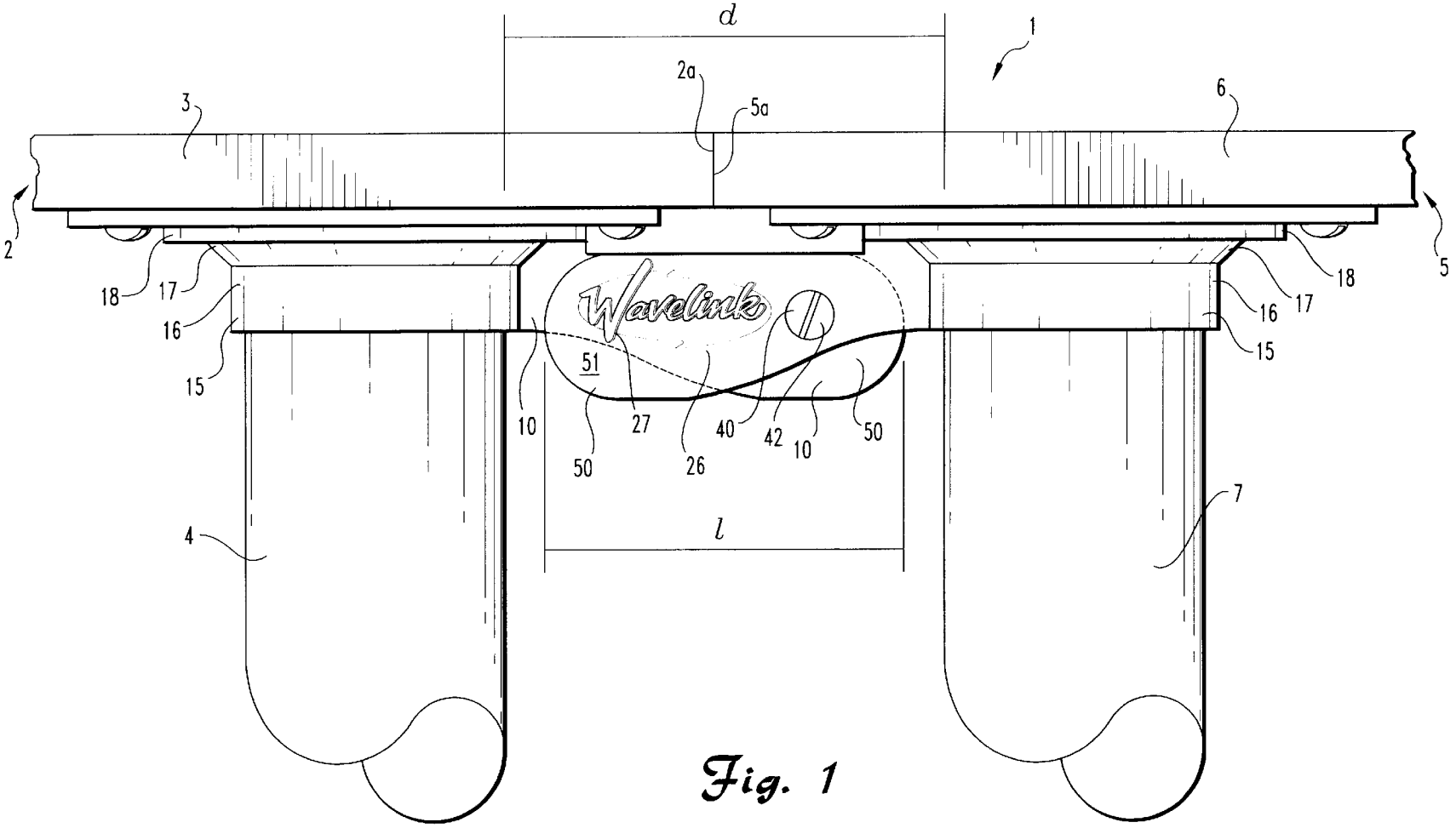
FIG. 1 is a side elevational view of a table and releasable connector assembly according to one embodiment of this invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention provides devices for ganging structures such as tables, desks and chairs, for convenient and safe releasable connection of the structures. The devices are particularly economical and convenient because each ganging device is universal. The devices also include a release tab that facilitates quick and easy release of a pair of engaged ganging devices.

In accordance with one embodiment of the invention and as shown in FIGS. 1–4, a furniture system 1 is provided. The furniture system 1 includes first and second structures. The structures are preferably tables 2 and 5, which have a first horizontal member such as desk tops 3, 6. The desk tops 3, 6 are supported by support members or table legs 4, 7. The system 1 also includes a releasable connection device 10 for each of the structures 2, 3.

Figure 2:
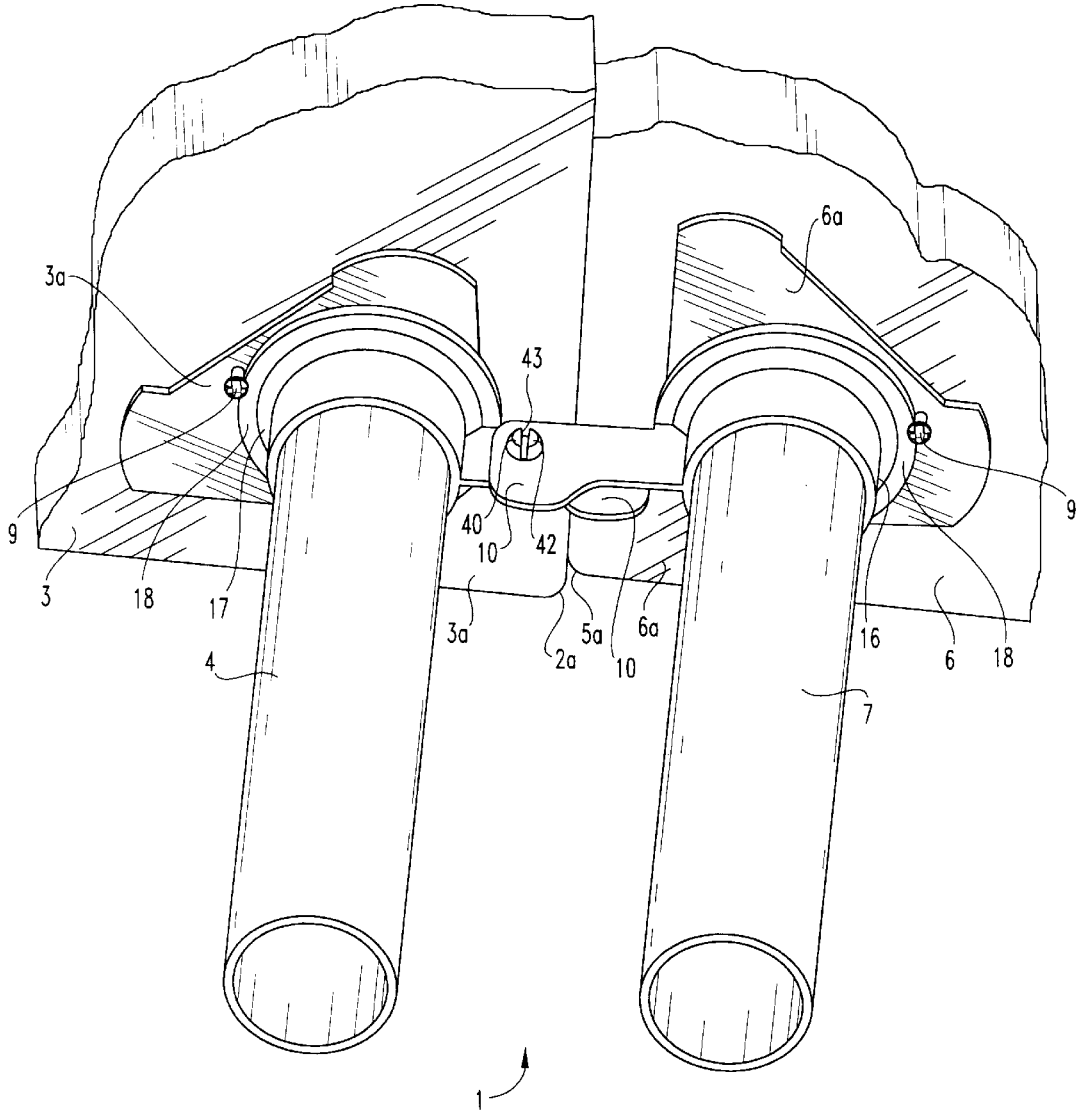
FIG. 2 is a bottom perspective view as shown in FIG. 1.
Figure 5:
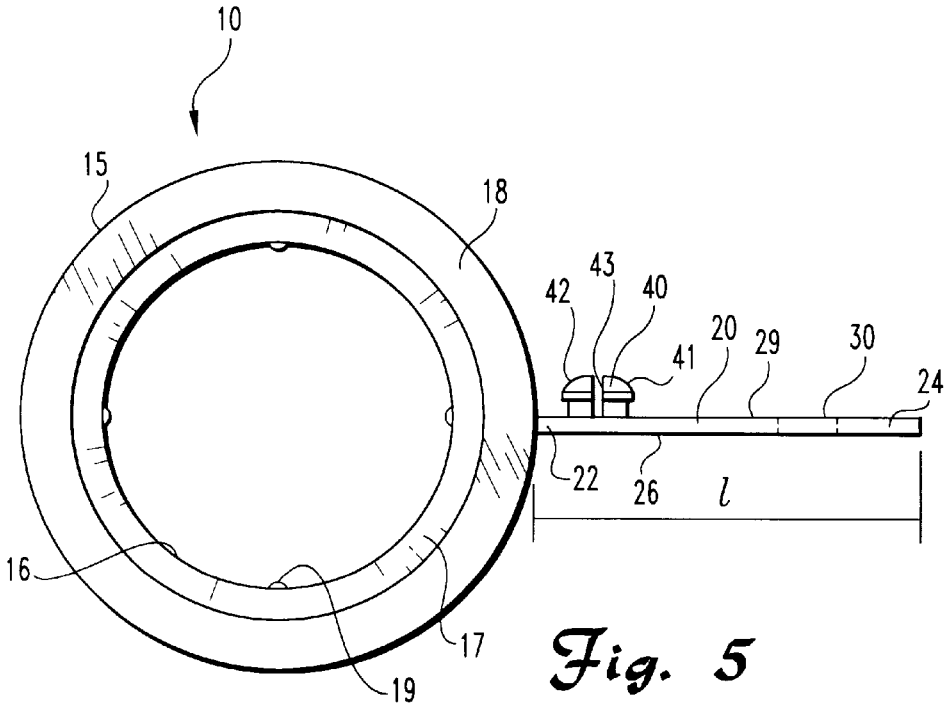
FIG. 5 is a bottom elevational view of a connector device according to another embodiment of this invention.
Figure 6:
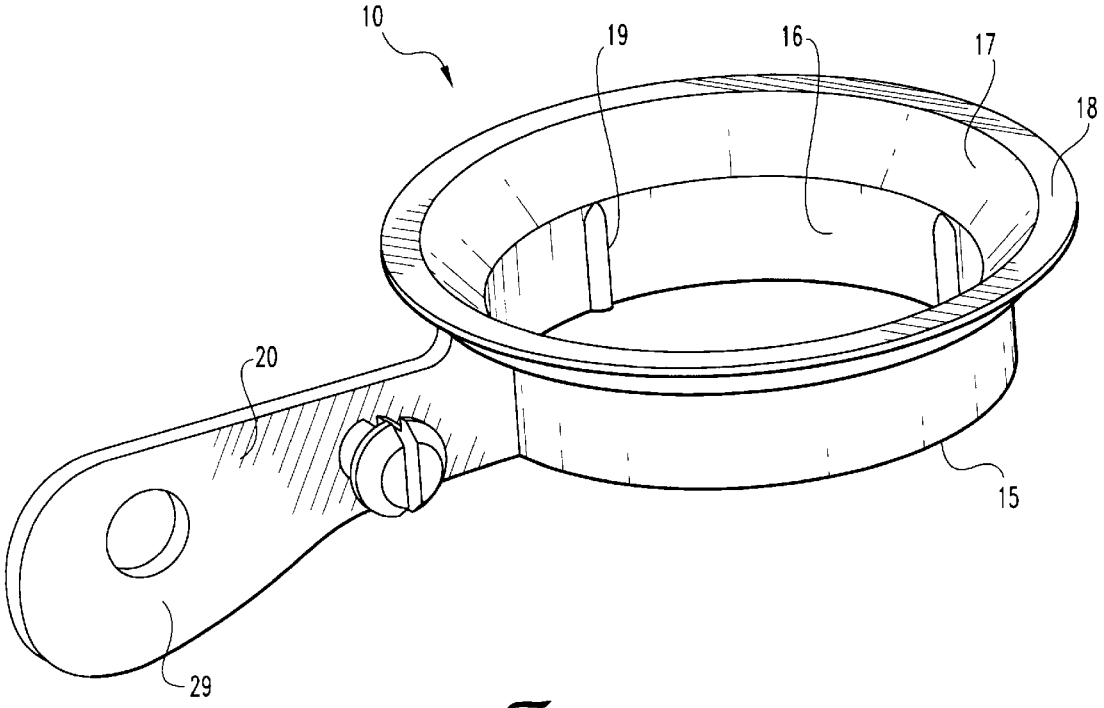
FIG. 6 is a side perspective view of the connector device shown in FIG. 5.

Each device 10 includes an attachment portion 15 engaged to one of the vertical support members 4, 7. In the preferred embodiment featured in the figures, the attachment portion 15 is a universal leash member that can be engaged to the undersurface 3*a*, 6*a* of the respective structure 3, 6. The universal leash member 15 includes a circular leg engaging member 16 that surrounds a perimeter of one portion of the leg members 4, 7 and conforms tightly to the geometry of the portion. In another embodiment, the flange 18 can be omitted so the leg engaging member 16 is freely rotatable around the perimeter of the leg 4, 7. In preferred embodiments and as shown in FIGS. 5 and 6, the leg engaging member 16 is preferably provided with means for gripping the vertical member 4, 7, such as the ridges 19. The universal leash 15 also includes a tapered region 17 connecting the leg engaging member 16 to a surface engaging flange 18. The universal leash 15 also includes a surface engaging flange 18 that engages an undersurface 3*a*, 6*a* of the structure 2, 5. Surface engaging flange 18 can be affixed to the undersurface 3*a*, 6*a* in any suitable manner. For example, it may be affixed by an adhesive or a fastener. As shown in FIG. 2, fastener 9 holds the flange 18 in place.

A connection portion 20 projects from the attachment portion 15, preferably the leg engaging member 16 of the attachment portion 15. The connection portion 20 has a first end 22 connected to the attachment portion 15 and an opposite second end 24 as shown most clearly in FIG. 5. The connection portion 20 extends perpendicularly from one of the table legs 4, 7 when the attachment portion 15 is engaged to one of the legs 4, 7. The connection portion 20 has a length l that is sufficient to span the distance d between the legs 4, 7 when the tables 2, 5 are placed with their edges 2*a*, 5*a* abutting one another as depicted in FIG. 1. The particular length l required will depend on the dimensions of the table. The outer surface 26 of the connection portion 20 can be provided with art work such as a company trademark 27.

Figure 7:
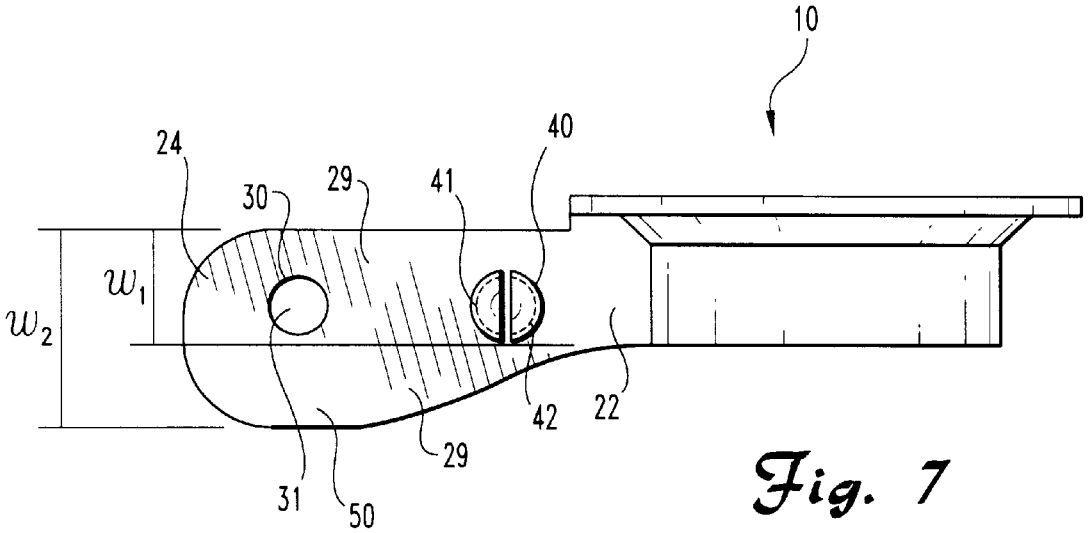
FIG. 7 is a side elevational view of the connector device shown in FIGS. 5 and 6.

The inner surface 29 of the connection portion 20 is provided with male and female fasteners 40, 30 in a universal arrangement. In this embodiment, a female fastener 30 is defined on the inner surface 29 and a male fastener 40 projects from the inner surface 29. The particular arrangement of the fasteners 30, 40 on the connection portion 20 is not critical so long as each device 10 has an identical arrangement of fasteners. For example, in this embodiment the male fastener 40 is adjacent the first end 22 of the connection portion 20 while the female fastener 30 is adjacent the opposite end 24. In this arrangement, the male and female fasteners are snap engageable with a respective female and male fastener 30, 40 of another releasable connection device 10. Any suitable male female fastener type is contemplated, for example, a snap fastener arrangement with a male knob component and a female socket component. The male fitting includes a knob releasably snap engageable in the female recess. The male member is then frictionally and removably secured within the female recess. In this way the connection portions 20 of two devices 10 can be repeatedly joined and disconnected. Preferably, the male fasteners 40 are of a split snap construction as shown most clearly in FIGS. 5 and 7. The fastener 40 includes a split in the middle to form a pair of prongs 41, each having enlarged feet 42 separated by a gap 43. The female member 30 preferably includes an opening 31 defined in or through the connection portion 20. The feet 42 of the male fastener 40 are snapped into or through opening 31 by closing the gap 43. In some embodiments, the male fastener 40 extends through the opening and passes beyond the outer surface 26 of the connection portion 20. Chamfers on the enlarged portion of the feet 42 permit easy passage into and out of openings 31. Once the enlarged portion of the feet 42 pass through the opening, the feet spring back to their original configuration. This split snap construction is preferred because they are less rigid than mushroom snaps. This construction also decreases manufacturing costs. However, any suitable snap type fastener is contemplated.

Figure 3:
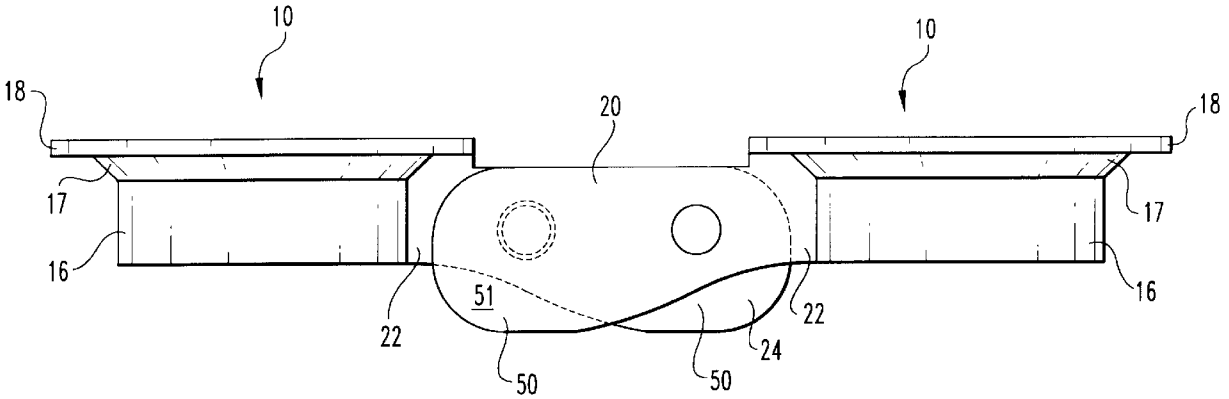
FIG. 3 is a side elevational view of a pair of engaged connector devices.
Figure 4:
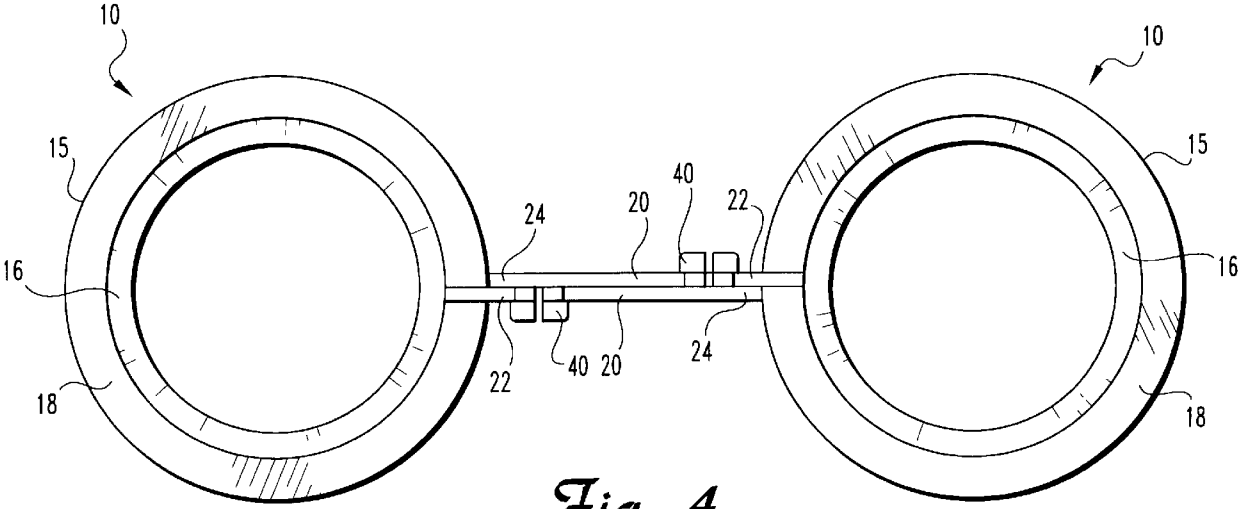
FIG. 4 is a bottom elevational view of the engaged devices shown in FIG. 3.

Preferably, the devices 10 further include a release portion extending from the opposite end 24 of the connection portion 20. The release portion has a release tab 50 contiguous with the surfaces 26, 29 of the connection portion 20. The release tab 50 extends outwardly from each of the engaging devices for receiving and transmitting a disengagement force to the fasteners. The release portion may be an increased width area at the opposite end 24 of the connection portion so that the first end of the connection portion 22 has a first width $w_1$ that is smaller than the width $w_2$ of the second end 24 of the connection portion 20. When the devices 10 are engaged, the release portion 50 will overlap only a portion of the opposite device, leaving a relief area 51 exposed as shown in FIG. 3. This relief area 51 and release tab 50 combine to provide a convenient thumb and forefinger release mechanism.

The devices 10 of the present invention will be constructed of any suitable material. The best materials will be economical, lightweight, resilient and attractive. Preferably the material will be black nylon, polypropylene and the like. In the preferred embodiments, the attachment portion 15, connection portion 20, fasteners 30, 40 and release tab 50 will be a single, continuous part.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A furniture ganging device for releasably connecting a first furniture structure to a second furniture structure, each of the structures having a member supported by a number of legs, the device comprising:

an attachment portion configured to engage one of the legs of the first furniture structure;

an elongated connection portion projecting from said attachment portion and having a first end attached to said attachment portion and an opposite second end, said connection portion configured for extending perpendicularly from the one of the legs when said attachment portion is engaged to the one of the legs;

a female fastener defined on a surface of said connection portion; and a male fastener projecting from said surface and adjacent said female fastener;

wherein said male and female fasteners are snap engageable with a respective female and male fastener of an identical one of said device engaged to the second furniture structure to form a pair of engaged devices.

2. The device of claim 1, further comprising:

a release portion extending from said opposite end of said connection portion, said release portion having a release tab contiguous with said surface of said connection portion, wherein said release tab extends outwardly from each of said pair of engaged devices for receiving and transmitting a disengagement force to said fasteners.

3. The device of claim 1, wherein said attachment portion is configured for surrounding a perimeter of one portion of the one of the less and conforming tightly to the geometry of the portion of the one of the legs.

4. A furniture system, comprising:

a first table having a first horizontal member and a number of first legs supporting said first horizontal member;

a second table having a second horizontal member and a number of second legs supporting said second horizontal member;

a releasable connection device for each of said first table and said second table, each said releasable connection device having an attachment portion configured to engage one of said legs of one of said tables;

an elongated connection portion projecting from said attachment portion and having a first end attached to said attachment portion and an opposite second end;

a female fastener defined on a surface of said connection portion; and a male fastener projecting from said surface and adjacent said female fastener;

wherein said male and female fasteners are snap engageable with a respective female and male fastener of the other of said releasable connection device engaged to one of said legs of the other of said tables to form a pair of engaged devices.

5. The system of claim 4, wherein said attachment portion surrounds a perimeter of one portion of the one of the legs and conforms tightly to the geometry of the portion of one of the legs.

6. The system of claim 4, wherein said connection portion extends perpendicularly from the one of the legs when said attachment portion is engaged to the one of the legs.

7. The system of claim 4, wherein each said connection device further includes:

a release portion extending from said opposite end of said connection portion, said release portion having a release tab contiguous with said surface of said connection portion wherein said release tab extends outwardly from each of said pair of engaged devices for receiving and transmitting a disengagement force to said fasteners.

8. The system of claim 7, wherein said release portion defines a relief adjacent said release tab, whereby the release tab of one connection device overlaps the relief of the other connection device.

9. The system of claim 8, wherein said relief of said release portion is defined adjacent said opposite end of said connection portion.

10. The device of claim 2, wherein said release portion defines a relief adjacent said release tab.

11. The device of claim 10, wherein said relief of said release portion is defined adjacent said opposite end of said connection portion.

12. A furniture ganging device for releasably connecting a first furniture structure to a second furniture structure, each of the structures having a member supported by a number of legs, the device comprising:

an attachment portion configured to engage one of the legs of the first furniture structure;

an elongated connection portion projecting from said attachment portion and having a first end attached to said attachment portion and an opposite second end;

a female snap fastener member defined on a surface of said connection portion; and a male snap fastener member projecting from said surface and adjacent said female snap fastener member;

wherein said male and female fasteners members are snap engageable with a respective female and male fastener of an identical one of said device engaged to the second furniture to form a pair of engaged devices.

13. The device of claim 12, wherein said attachment portion is configured to surround a perimeter of one portion of the one of the legs and conform tightly to the geometry of the portion of one of the legs.

14. The device of claim 12, wherein said connection portion projects from said attachment portion so that said connection portion is extendable perpendicularly from the one of the legs when said attachment portion is engaged to the one of the legs.

15. The device of claim 12, further comprising:

a release portion extending from said opposite end of said connection portion, said release portion having a release tab contiguous with said surface of said connection portion.

16. The device of claim 15, wherein said release portion defines a relief adjacent said release tab, whereby the release tab of one connection device overlaps the relief of another connection device when the device is engaged to said another device identical to the device.

17. The device of claim 16, wherein said relief of said release portion is defined adjacent said opposite end of said connection portion.

18. The device of claim 12, wherein said female snap fastener includes a socket component and said male snap fastener includes a knob component and said male knob component is frictionally securable within said female socket component.

19. The device of claim 18, wherein said knob component of said male snap fastener includes a pair of prongs separated by a gap and an enlarged foot disposed on an end of each said prong.

20. The device of claim 4, wherein said female fastener is a snap fastener including a socket component and said male fastener is a snap fastener including a knob component and said male knob component is frictionally securable within said female socket component.

21. The device of claim 20, wherein said knob component of said male snap fastener includes a pair of prongs separated by a gap and an enlarged foot disposed on an end of each said prong.

* * * * *